United States Patent [19]

Jennison

[11] 4,165,812

[45] Aug. 28, 1979

[54] MULTI-CONTAINER PACKAGE

[75] Inventor: James S. Jennison, Burlington, Iowa

[73] Assignee: Riley Brothers, Inc., Burlington, Iowa

[21] Appl. No.: 921,577

[22] Filed: Jul. 3, 1978

[51] Int. Cl.[2] ..... B65D 21/02

[52] U.S. Cl. ..... 215/10; 220/23.4

[58] Field of Search ..... 220/23.4; 215/6, 10; D9/18

[56] References Cited

U.S. PATENT DOCUMENTS 3,385,465 5/1968 Bliss ..... 220/23.4

3,702,806 11/1972 Oliva ..... 220/23.4 X

FOREIGN PATENT DOCUMENTS 460545 10/1949 Canada ..... 220/23.4

*Primary Examiner*—Donald F. Norton

*Attorney, Agent, or Firm*—Robert E. Wagner; Thomas L. Kautz

[57] ABSTRACT

A means of detachably connecting a plurality of containers in an integral facing relationship is provided by the present invention, wherein up to four separate containers may be internally secured together to form a compact multi-unit package.

3 Claims, 4 Drawing Figures

MULTI-CONTAINER PACKAGE

BACKGROUND OF THE INVENTION

The present invention relates generally to the field of multi-unit packaging of containers, and, more specifically, to an attaching means integral with each container for securing up to four containers together in a self-contained unit.

Known devices for packaging or bundling a plurality of cans, bottles or other containers in a compact and economically feasible package, are of varied design and structure. One type of device includes containers which are formed to stack side by side and/or one on top of the other in a close relationship. Such containers are then "packaged" together for shipment by wrapping an external securing means such as a rope or strap around the outer surfaces of the containers as disclosed in U.S. Pat. No. 3,369,658. One problem with this packaging design, is that should the rope or strap around the containers loosen or break during shipment, the containers are free to separate since no internal fastening means between adjacent containers is provided.

Other devices provide means to cause adjacent containers to adhere to one another for a minimum of movement during shipment. As disclosed in U.S. Pat. No. 3,759,373, an adhesive material may be applied on the sides of adjacent containers to connect them together. Such devices do not rely on external securing means to hold the containers together, but it has been found that the nature and strength of the adhesive material used limits its application to disposable containers intended for a single use.

SUMMARY OF THE INVENTION

The present invention provides resilient fastening means integral with the surfaces of each container, which is durable and allows for repeated use of the containers. Each container is provided with a recessed portion on one surface formed in alignment with a projection on an opposite surface. Up to four containers may be joined as a single unit by inserting the projection on the face of one container into a corresponding recess in the abutting face of an adjacent container. The projections tightly interlock within the interior of the recesses, to hold the containers securely together.

No external attaching means such as a rope or strap is required with the present invention, since the containers are interlocked by a unique fastening means, internal to the container unit, which is formed in the interior or abutting surfaces of each individual container in the unit. If any one or more of the individual containers in the unit is bumped or jostled during shipment, such container would tend to either move inwardly toward the abutting surfaces of adjacent containers, or against the upper or lower edges of the recess portions of adjacent containers, thus minimizing the chance of separation, as discussed below.

Therefore, it is an object of this invention to provide means whereby a plurality of containers may be secured tightly together as a single unit without external holding or securing means.

It is another object of the present invention to provide a plurality of containers each having a recessed portion on one face and a projection on an opposite face, the recessed portion on the face of one container being formed to tightly interlock with the projection on an abutting face of an adjacent container for securing up to four containers together as a single unit.

DETAILED DESCRIPTION OF THE INVENTION

Figure 1:
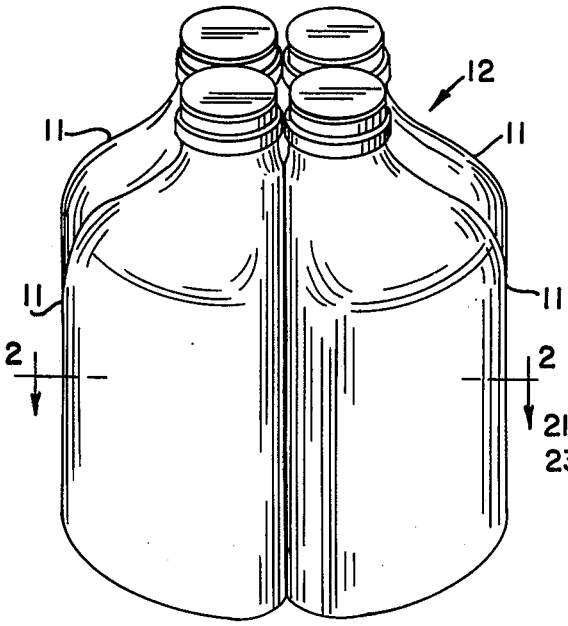
FIG. 1 is an overall perspective view of four containers connected together by the packaging means of the present invention.
Figure 2:
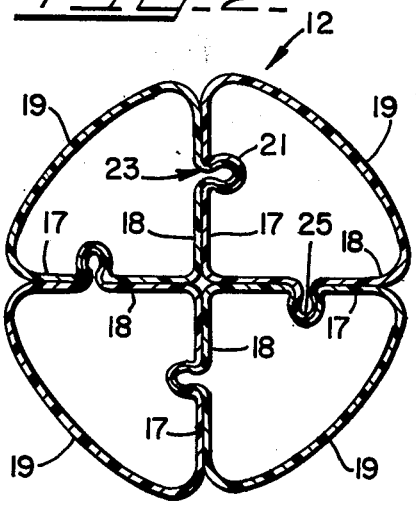
FIG. 2 is a cross-sectional view taken generally along line 2—2 of FIG. 1 showing the engagement means for packaging the containers together as a single unit.

Referring now to the drawings and in particular to FIG. 1, four containers 11 are shown in an engaged relationship forming a single container unit, labelled with the reference 12. The containers 11 are formed of a resilient material such as polyethylene, thin gauge sheet metal or any suitable equivalent. As shown in FIG. 2, the containers 11 are essentially triangular in shape, have two generally straight surfaces or faces 17 and 18, which abut at substantially a right angle. The outer portion of each container 11 is a curved surface 19, so that when connected together, four containers 11 form a compact generally circular unit 12.

Figure 3:
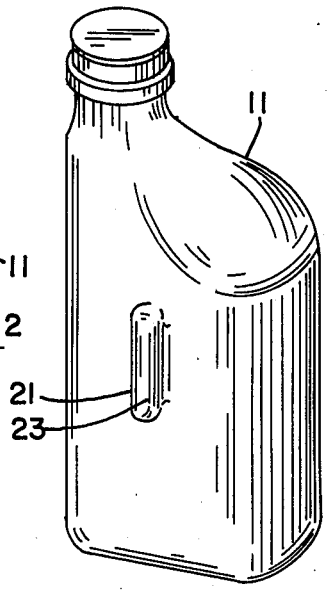
FIG. 3 is a perspective view in full elevation showing the face of a container having a recessed portion.
Figure 4:
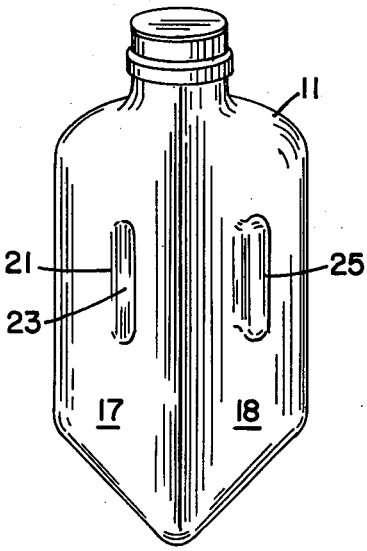
FIG. 4 is a perspective view in full elevation showing the two interior faces of a container, one face having a projecting portion in alignment with a recessed portion formed in the other face.

As shown in FIGS. 3 and 4, a recess 21 is formed approximately in the center of face 17 of container 11. The recess 21 extends into the interior of container 11 forming a generally circular cross section or arc which narrows into an elongated opening 23, in the face 17 of container 11. The opposite face 18 of each container 11 is formed with a projection 25 extending outwardly from face 18 in alignment with recess 21 of face 17.

The projection 25 and recess 21 of each container 11 form the engagement means of the present invention. Two or more containers 11 are connected together by forcing the projection 25 on face 18 of one container 11, through the opening 23 on the face 17 of an adjacent container 11 and into engagement with the interior of the recess 21 of such adjacent container 11. The exterior dimensions of the projections 25 are slightly greater than those of openings 23, and slightly less than the interior dimensions of the recesses 21. The resiliency of the container material enables the projections 25 to deform slightly and the openings 23 to expand slightly as adjacent containers 11 are connected together. When separated, the projections 25 and openings 23 return to their original shapes. In contrast to many existing types of multi-container packaging devices, the resilient containers 11 of the present invention are thus reuseable again and again with limited weakening of the strength of engagement therebetween.

As mentioned above, the present invention provides unqiue engagement means which is both integral with each container 11 and internal to the container unit 12. The critical connection or engagement between adjacent containers 11, which is the sole means of holding them together, occurs in the interior of the container unit 12 between the abutting surfaces 17 and 18 of adjacent containers 11. This connection does not require the use of straps or cords wrapped around the outer surface of multi-container packages as in many prior art devices, which are subject to loosening or failure should the containers be mishandled during shipment or storage.

In FIG. 2, a compact four-container unit 12 is shown, which is the preferred embodiment of the present invention. The four-container unit 12 is a particularly secure arrangement of the containers 11 of the present invention. Each container 11 in the four-container unit 12 is held at two points; the projection 25 on face 18 of a first container 11 is inserted into the recess 21 of an adjacent second container 11, and the recess 21 on face 17 of such first container 11 receives the projection 25 on face 18 of a third container 11. If the outer surface 19 of a container 11 is bumped or jarred inwardly, such container 11 is forced toward the middle of the container unit 12 where engagement between alternative recesses 21 and projections 25 occurs.

Vertical separation of the containers 11 with respect to one another is also reduced by the engagement means of the present invention. As shown in FIGS. 3 and 4, recesses 21 are of fixed length and extend into the interior of containers 11. Forces applied to the top or bottom of the container unit 12 are resisted as the projection 25 of one container 11 is forced against the upper or lower edge of the recess 21 of an adjacent container 11. As can be observed, the containers 11 may be separated by pulling each one directly outwardly from the center of the container unit 12.

Although the containers 11 of the present invention are shown in a four-container unit, it should be understood that two or three containers 11 may be secured without substantially reducing the effectiveness of the connection. As discussed above, projections 25 and recesses 21 are sized to tightly engage one another with a force sufficient to hold two containers 11 securely together even though the connection is at only one point as opposed to the two point connection of each container 11 in the four-container unit.

While the invention has been particularly shown and described with reference to a preferred embodiment thereof, it will be understood by those skilled in the art that various changes in form and details may be made therein without departing from the spirit and scope of the invention.

I claim:

1. A multi-container package comprising a plurality of containers formed of a flexible material, each container having a first side wall, a second side wall, and an outer wall connected together to form said containers, said first side wall being formed with a recess disposed along a limited portion thereof and extending into the interior of said container, said recess forming an opening at the face of said first side wall having a cross section slightly less than the cross section of said recess, said second side wall having a projection extending from the face thereof in direct alignment with said opening in the face of said first side wall, said projection having exterior dimensions slightly greater than the cross section of said opening at the face of said first side wall, and slightly less than the cross section of said recess, whereby a plurality of said containers are secured tightly together from relative movement in all directions by inserting a projection on the second side wall of one container directly through the corresponding opening in an abutting first side wall of an adjacent container to releaseably mate with the recess of said adjacent container while providing a positive attachment therebetween to form said multi-container package.

2. The multi-container package of claim 1 wherein four containers are secured together by interengaging a projection on the second side wall of one container with a recess in an abutting first side wall of an adjacent container, thereby forming a compact package unit.

3. The multi-container package of claim 1 wherein said containers are formed of a resilient material whereby a projection of one container may be repeatedly inserted through the opening and into the recess of a second container with minimal loss in the strength of engagement therebetween.

* * * * *